US008305069B2

(12) United States Patent
Bouwman et al.

(10) Patent No.: US 8,305,069 B2
(45) Date of Patent: Nov. 6, 2012

(54) BANDGAP REFERENCE CIRCUIT AND METHOD FOR PRODUCING THE CIRCUIT

(75) Inventors: Jeroen Bouwman, Nijmegen (NL); Léon C. M. van den Oever, Rosmalen (NL)

(73) Assignee: Epcos AG, Munich (DE)

( * ) Notice: Subject to any disclaimer, the term of this patent is extended or adjusted under 35 U.S.C. 154(b) by 0 days.

(21) Appl. No.: 13/039,785

(22) Filed: Mar. 3, 2011

(65) Prior Publication Data

US 2011/0215789 A1 Sep. 8, 2011

Related U.S. Application Data

(63) Continuation of application No. PCT/EP2010/052856, filed on Mar. 5, 2010.

(51) Int. Cl.
*G05F 3/16* (2006.01)

(52) U.S. Cl. ..... 323/313

(58) Field of Classification Search ..... 323/313, 323/315, 907; 327/513, 540; 330/127
See application file for complete search history.

(56) References Cited

U.S. PATENT DOCUMENTS

| | | | | |
|---|---|---|---|---|
| 6,122,497 | A | 9/2000 | Gilbert | |
| 7,948,305 | B2 * | 5/2011 | Shirokov et al. | 327/540 |
| 2003/0151396 | A1 | 8/2003 | Self et al. | |
| 2009/0256628 | A1 | 10/2009 | Ilkov et al. | |

FOREIGN PATENT DOCUMENTS

| | | | |
|---|---|---|---|
| EP | 0798618 | A1 | 1/1997 |
| EP | 2187432 | A1 | 5/2010 |
| WO | 94/03850 | A2 | 2/1994 |
| WO | 2009/153618 | A1 | 12/2009 |

OTHER PUBLICATIONS

Peatman W. et al. "InGaP-Plus™: Advanced GaAs BiFET Technology and Applications", CS Mantech Conference, Austin, Texas 2007, pp. 243-246.
Sansen "Analog Design Essentials", Dordrecht, Springer, 2006, pp. 465-466, ISBN 0-387-25746-2.
Cressler, J. D. "On the Potential of SiGe HBTs for Extreme Environment Electronics" Proceedings of the IEEE; Sep. 1, 2005; vol. 93; No. 9; pp. 1559-1582.

(Continued)

*Primary Examiner* — Adolf Berhane
*Assistant Examiner* — Yemane Mehari
(74) *Attorney, Agent, or Firm* — Nixon Peabody LLP

(57) ABSTRACT

Bandgap reference circuit, comprising a voltage generator (VG) designed to produce a voltage or a current proportional to absolute temperature, a supply circuit (SC), designed to produce a supply for operating the voltage generator (VG), comprising a bias element (BS) and a control element (CS), and a bias circuit (BC), designed to produce a bias for operating the voltage generator (VG), comprising a bias element (BB) and a control element (CB). At least one of the control element (CS) of the supply circuit (SC) and the control element (CB) of the bias circuit (BC) comprises a pseudomorphic high-electron-mobility transistor or a hetero-junction bipolar transistor and/or at least one of the bias element (BS) of the supply circuit (SC) and the bias element (BB) of the bias circuit (BC) comprises a long-gate pseudomorphic high-electron-mobility transistor or a resistor. Method for producing the circuit wherein the pseudomorphic high-electron-mobility transistors and the hetero-junction bipolar transistors are produced using a GaAs BiFET technology process.

19 Claims, 5 Drawing Sheets

OTHER PUBLICATIONS

Cressler, J. D. et al. "Proton Radiation Response of SiGe HBT Analog and RF Circuits and Passives" IEEE Transactions on Nuclear Science; Dec. 1, 2001; vol. 48; No. 6 (6 pages).
Hui Dong, L. et al. "A Temperature-Independent Transmitter IC for 5.8-GHz DSRC Applications" IEEE Transactions on Circuits and Systems; Jul. 1, 2008; vol. 55; No. 6; pp. 1733-1741.
Kevin Jing Chen "GaN Smart Power Chip Technology" Electron Devices and Solid State Circuits; Jan. 25, 2009; pp. 403-407.
Laleh, N. et al. "Proton Tolerance of SiGe Precision Voltage References for Extreme Temperature Range Electronics" IEEE Transactions on Nuclear Science; Dec. 1, 2006; vol. 53; No. 6' pp. 3210-3216.
Laleh, N. et al. "Radiation Response of SiGe BiCMOS Mixed-Signal Circuits Intended for Emerging Lunar Applications" Radiation and its Effects on Components and Systems; IEEE Sep. 10, 2007; pp. 1-5; ISBN 978-1-4244-1704-9.
Schleicher, B, et al. "Si/SiGe HBT UWB Impulse Generators with Sleep-Mode Targeting the FCC Masks" International Conference on Ultra-Wideband; Sep. 9, 2009; pp. 674-678; ISBN 978-1-4244-2930-1.
Gilbert, B. "Monolithic voltage and current references: Theme and Variations" Analog circuit Design, H. Huijsing, R. van de Plassche, and W. Sansen, (Eds) 1996 Kluwer Academic Publishers, 99. 269-352, ISBN 0-7923-9659-6.

* cited by examiner

BANDGAP REFERENCE CIRCUIT AND METHOD FOR PRODUCING THE CIRCUIT

CROSS-REFERENCE TO RELATED APPLICATION

This application is a continuation of prior International Patent Application Serial No. PCT/EP2010/052856, filed Mar. 5, 2010, entitled "Bandgap Reference Circuit and Method for Producing the Circuit," which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

BACKGROUND OF THE INVENTION

The invention concerns a bandgap reference circuit for providing a voltage or a current in which first order effects of temperature dependency are cancelled. Bandgap reference circuits can be used in high-frequency applications such as power amplifiers of mobile phones, which are usually manufactured using gallium arsenide (GaAs).

BRIEF SUMMARY OF THE INVENTION

It is an object of the invention to provide a bandgap reference circuit that is implemented in GaAs technology, has a low minimum required supply voltage, occupies a small chip area, has a low current consumption and is robust against supply voltage variations.

The invention solves the objective by providing a bandgap reference circuit comprising a voltage generator designed to produce a voltage or a current proportional to absolute temperature, a supply circuit designed to produce a supply for operating the voltage generator, comprising a bias element and a control element, and a bias circuit designed to produce a bias for operating the voltage generator, comprising a bias element and a control element. At least one of the control element of the supply circuit and the control element of the bias circuit comprises a pseudomorphic high-electron-mobility transistor (pHEMT) and/or at least one of the bias element of the supply circuit and the bias element of the bias circuit comprises a long-gate pseudomorphic high-electron-mobility transistor. In high-electron-mobility transistors (HEMT), high-mobility electrons are generated using a hetero-junction. Elements that are not pHEMTs can be realized respectively by a hetero-junction bipolar transistor (HBT). A hetero-junction is a junction between two materials with different bandgaps. The different materials may have different lattice constants. In pseudomorphic high-electron-mobility transistors (pHEMT), the layers of the different materials are so thin that the lattices are matched. A hetero-junction bipolar transistor (HBT) is a bipolar transistor where emitter region, collector region and base region contain different materials, thus creating a hetero-junction. Using pHEMT transistors for the control element of the supply circuit and/or the control element of the bias circuit reduces the minimum required supply voltage. The use of long-gate pHEMT transistors for the bias element of the supply circuit and/or the bias element of the bias circuit allows large resistances to be realized with reduced chip areas. The large resistances lead to a reduction of current consumption and to a larger voltage gain which reduces the sensitivity to supply voltage variations.

In an embodiment, the pseudomorphic high-electron-mobility transistor of the control element of the supply circuit and/or the pseudomorphic high-electron-mobility transistor of the control element of the bias circuit is a depletion-mode transistor. Depletion-mode transistors are normally on and operate with a negative threshold voltage which reduces the minimum required supply voltage.

In an embodiment, the pseudomorphic high-electron-mobility transistor of the control element of the supply circuit and/or the pseudomorphic high-electron-mobility transistor of the control element of the bias circuit is an enhancement-mode transistor. Using enhancement-mode transistors also reduces the minimum required supply voltage compared to a hetero-junction bipolar transistor.

In an embodiment, the long-gate pseudomorphic high-electron-mobility transistor is a depletion-mode transistor and comprises an active region of width W and length L, wherein the ratio of the width W to the length L lies between 0.01 and 0.1. Such transistors have high equivalent AC-resistances.

In an embodiment, the gate and a source of the long-gate pseudomorphic high-electron-mobility transistor are electrically shorted or are coupled to each other by at least one electrical component so that the voltage between the gate and the source Vgs lies between the negative threshold voltage Vth and 0 V, that is $Vth<Vgs<0$ V. The long-gate pseudomorphic high-electron-mobility transistor then functions as a current source.

In an embodiment, a first connection point of the bias element of the supply circuit and a first connection point of the control element of the supply circuit are each connected to a first supply potential, and a second connection point of the bias element of the supply circuit is connected to a control input of the control element of the supply circuit.

In an embodiment, the second connection point of the bias element of the supply circuit is connected to a first connection point of another control element of the supply circuit, wherein a second connection point of the other control element of the supply circuit is connected to a second supply potential.

In an embodiment, a first connection point of the bias element of the bias circuit and a first connection point of the control element of the bias circuit are each connected to a first supply potential, and a second connection point of the bias element of the bias circuit is connected to a control input of the control element of the bias circuit.

In an embodiment, the second connection point of the bias element of the bias circuit is connected to a first connection point of another control element of the bias circuit, and a second connection point of the other control element of the bias circuit is connected to the second supply potential.

In an embodiment, the second connection point of the control element of the bias circuit is connected to a first connection point of a resistor of the bias circuit, a second connection of the resistor of the bias circuit is connected to a first connection point of still another control element of the bias circuit, the first connection point of the still another control element is connected to a control input of the still another control element, and a second connection point of the still another control element of the bias circuit is connected to the second supply potential.

In an embodiment, the voltage generator comprises a first control element and a second control element, each having a first connection point, a second connection point and a control input, wherein the first control element and the second control element have emitter areas that differ from one another, the control input of the first control element and the control input of the second control element are connected to the control input of the still another control element of the bias circuit, the first connection point of the first control element is connected to the control input of the further control element of the supply circuit, the second connection point of the first control element is connected to the second supply potential, and the first connection point of the second control element is connected to the control input of the other control element of the bias circuit.

In an embodiment, the voltage generator further comprises a first resistor, a second resistor and a third resistor, wherein a first connection point of the first resistor is connected to the second connection point of the control element of the supply circuit and a second connection point of the first resistor is connected to the first connection point of the first control element, a first connection point of the second resistor is connected to the second connection point of the control element of the supply circuit and a second connection point of the second resistor is connected to the first connection point of the second control element, and a first connection of the third resistor is connected to the second connection point of the second control element and a second connection point of the third resistor is connected to the second supply potential.

In an embodiment, the first control element and the second control element of the voltage generator, the other control element of the supply circuit, the other control element and the still other control element of the bias circuit, and any of the control elements of the supply circuit and the control element of the bias circuit and the bias element of the supply circuit and the bias element of the bias circuit, which are not pseudomorphic high-electron-mobility transistors, are hetero-junction bipolar transistors.

The invention further provides a method for producing the circuit where the pseudomorphic high-electron-mobility transistors and the hetero-junction bipolar transistors are produced using a GaAs BiFET (Bipolar Field Effect Transistor) technology process. Further, the bandgap reference circuit can be implemented in any other compound semiconductor technology with combinations of Bipolar/FET or Bipolar/pHEMT elements that are manufactured in the same process. Most preferred are Bipolar/pHEMT combinations in the same process which is called BiFET technology. But any combinations of bipolar and other types of Field Effect Transistors (FETs) like MESFET (Metal Semiconductor Field Effect Transistor) for example on GaAs base or on any other compound semiconductor can be used within a bandgap reference circuit according to the invention.

As far as a DC circuit element is referred to a MESFET realized in a compound semiconductor may be preferred in view of a pHEMT because a MESFET can be easier integrated into bipolar technology and offers a low cost process. As far as RF elements are regarded pHEMT elements are preferred in view of MESFET.

Further, the bipolar transistor may selected from a hetero-junction (HBT) or a homojunction (BJT) transistor.

BRIEF DESCRIPTION OF THE DRAWINGS

Embodiments of the present invention will now be described, by way of example, with reference to the accompanying drawings. The drawings show.

DETAILED DESCRIPTION OF THE INVENTION

Figure 1:
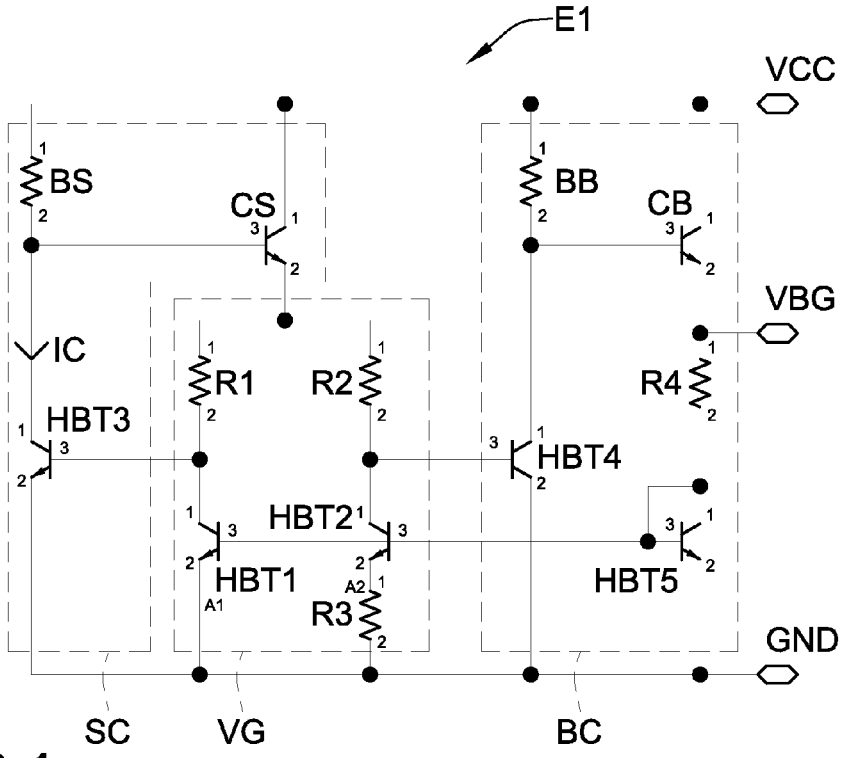
FIG. 1 illustrates a first embodiment of a bandgap reference circuit.

FIG. 1 shows a first embodiment E1 of a bandgap reference circuit comprising a voltage generator VG, a supply circuit SC and a bias circuit BC. The supply circuit SC and the bias circuit BC are connected to a first supply potential VCC and to a second supply potential GND. The voltage generator VG is connected to the supply circuit SC, the bias circuit BC, and the second supply potential GND. The supply voltage is the difference between the first supply potential VCC and the second supply potential GND and is equal to VCC if the second supply potential GND is chosen to be 0 V.

The voltage generator VG comprises a first, a second and a third resistor R1, R2 and R3 which each have a first connection point 1 and a second connection point 2. The first, second and third resistors R1, R2 and R3 can be thin film resistors. The first and second resistor R1 and R2 may have equal resistances. It further comprises a first and a second control element HBT1 and HBT2 which each have a first connection point 1, a second connection point 2 and a control input 3. The circuit elements are connected as described above. The first and second control elements HBT1 and HBT2 can be transistors. For example, they can be NPN hetero-junction bipolar transistors (HBT), where the first connection points 1 correspond to collectors, the second connection points 2 correspond to emitters and the control inputs 3 corresponds to bases. The emitter areas of the first and second control element HBT1 and HBT2 are A1 and A2 with A2=M×A1. The current flowing through the third resistor R3 is then proportional to the thermal voltage VT=kT/q, that is it is proportional to the absolute temperature T (PTAT). It is also proportional to ln(M).

The supply circuit SC comprises a bias element BS, a control element CS and another control element HBT3. The bias element BS has a first and a second connection point 1 and 2, the control element CS and the another control element HBT3 each have a first and a second connection point 1 and 2 and a control input 3. The circuit elements are connected as described above. The control element CS and the another control element HBT3 can be NPN hetero-junction bipolar transistors, where the first and second connection points 1 and 2 and the control input 3 are collectors, emitters and bases, respectively. The control element CS is used to supply current to the voltage generator VG. The bias element BS can be a resistor, such as a thin film resistor and serves as a current source to set the bias current through the other control element HBT3 and determines the AC-loop gain. The control element CS, the other control element HBT3 and the first resistor R1 form a loop which determines the voltage at the second connection point 2, that is at the emitter of the control element CS.

The bias circuit BC comprises a bias element BB, a control element CB, a fourth resistor R4, another control element HBT4 and still another control element HBT5. The another control element HBT4 serves as a complementary to absolute temperature (CTAT) voltage generator. The bias element BB and the fourth resistor R4 each have first and second connection points 1 and 2, while the control element CB, the another control element HBT4 and the still another control element HBT5 each have a first and a second connection point 1 and 2 and a control input 3 and can be NPN hetero-junction bipolar transistors in which case the first and second connection points 1 and 2 and the control input 3 are a collector, an emitter and a base, respectively. The circuit elements are connected as described above. The bandgap reference voltage VBG can be tapped off at the first connection point 1 of the fourth resistor R4 and the second connection point 2 of the control element CB. In a similar manner to the supply circuit SC, the bias element BB sets the bias current through the other control element HBT4 and determines the AC-loop gain. The still other control element HBT5 has its first connection point 1 connected to its control input 3 and provides a voltage for the control inputs 3 of the first and second control element HBT1 and HBT2 of the voltage generator VG. The voltage at its control input 3 is determined by the loop formed by the control element CB, the fourth resistor R4 and the other control element HBT4. The bias circuit BS receives a potential from the voltage generator VG at the control input 3 of the other control element HBT4.

The combination of the proportional to absolute temperature (PTAT) voltage with the complementary to absolute temperature (CTAT) voltage leads to the desired temperature behavior of the bandgap voltage VBG.

The transistors in the first embodiments E1 can be GaAs hetero-junction bipolar transistors. Such transistors have a Vbe of 1.15 to 1.2 V at 300 k. For proper operation, the voltage across resistors BS, BB and R1, R2 should be about 500 mV. With Vbe=1.15 V of the HBT CS and HBT3, this will require a minimum required supply voltage of VCC=2×500 mV+2×1.15 V=3.3 V. At lower temperatures the minimum required supply voltage will be somewhat higher. A minimum required supply voltage of 3.3 V can be a disadvantage in battery-operated products, such as for example wireless communication devices, since there is a trend towards lowering the supply voltages from 3.2 V to 2.8 V and even lower down to 2 V.

Figure 2:
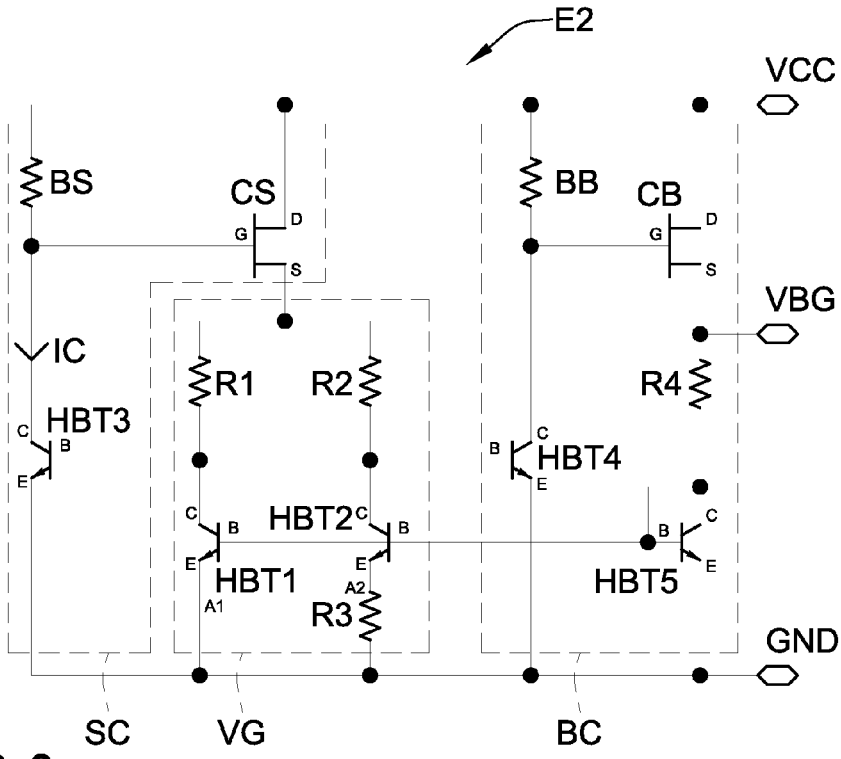
FIG. 2 illustrates a second embodiment of a bandgap reference circuit.

The second embodiment E2 shown in FIG. 2 helps to overcome this problem. The numbering of the first and second connection points 1 and 2 and the control inputs 3 are only shown in FIG. 1 and for clarity reasons are not shown in FIGS. 2, 3 and 6. However, the second, third and fourth embodiments are modifications of FIG. 1 and function similarly so that the features described with FIG. 1 also apply to these embodiments.

The hetero-junction bipolar transistor for the control element CS for the supply circuit SC and for the control element CB for the bias circuit BC in FIG. 1 are replaced with pseudomorphic high-electron-mobility transistors CS and CB in FIG. 2. These transistors can be depletion-mode transistors where, due to the typical Ids/Vgs characteristics with a V_threshold of about −1 V, the voltage at the control input 3, that is the gate G of the transistor, is around 0.75 V. The minimum required supply voltage VCC depends on the voltage Vds between the drain D and source S of the control element CB of the bias circuit BC. This in turn depends on the size of the transistor and the load current of the circuit. With proper scaling of the transistor CB, the supply voltage VCC can be decreased to 1.8 V for a bandgap reference voltage of 1.6 V with a Vds of about 0.2 V for CB.

The control element CB and CS of the bias circuit BC and the supply circuit SC, respectively, can be replaced by enhancement-mode pHEMT transistors. The minimal required supply voltage VCC will be approximately 2.6 V, which is higher than when depletion-mode transistors are used, but is still adequately low for many applications.

The HBT and the pHEMT transistors are available in merged or stacked GaAs FET-HBT integration schemes. Such integration schemes are often called BiFET or BiHEMT and contain both HBT and FET/pHEMT devices on a single GaAs substrate.

In GaAs technology, only thin-film resistors are available with a sheet resistance of 50 Ω/square so that a large resistor of several tens of kΩ occupies a very large chip area. The resistances BS and BB shown in FIGS. 1 and 2 need to be large in value to achieve a low current consumption and a high AC-loop gain. However, for a resistor, its DC voltage and the AC-loop gain are tightly coupled and the use of large resistors leads to problems with the DC voltage headroom available. When the voltage across resistor BS and BB is decreased due to a lower supply voltage VCC, the collector current in HBT3 and HBT4 is also decreased which results in a lower loop gain.

Figure 3:
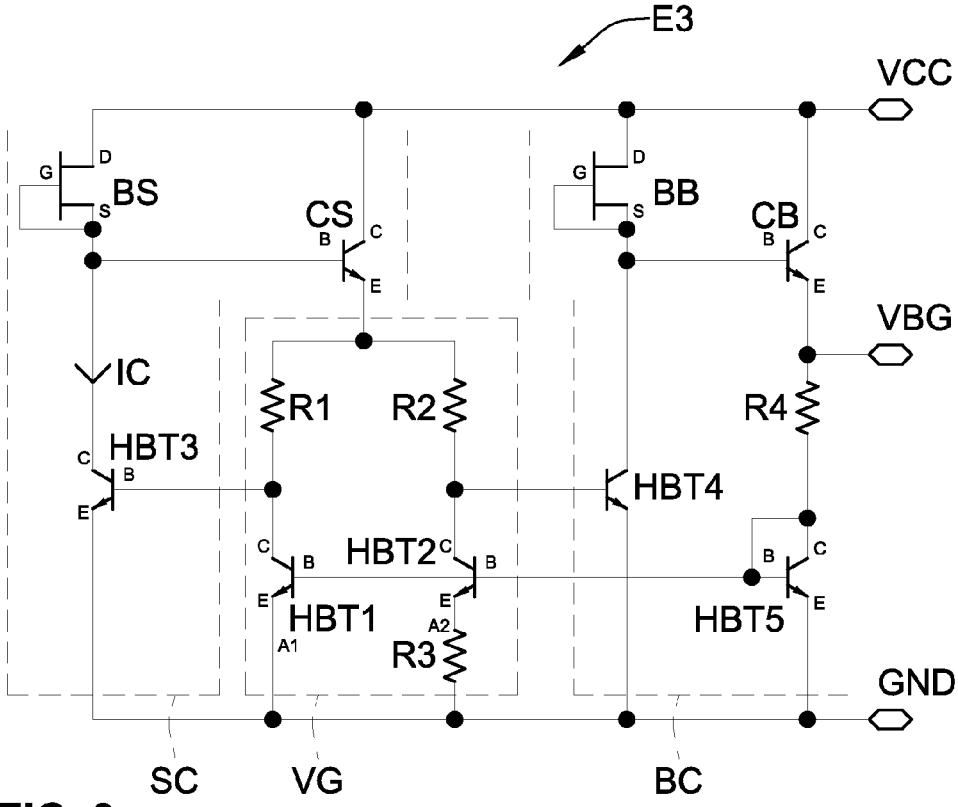
FIG. 3 illustrates a third embodiment of a bandgap reference circuit.

To overcome these problems the first embodiment E1 shown in FIG. 1 can be modified to become the third embodiment E3 shown in FIG. 3. In FIG. 3, the resistors BS and BB of FIG. 1 are replaced by depletion-mode long-gate pHEMT transistors BS and BB, with the respective gates G short-circuited to the respective source S. The drain D corresponds to the first connection point 1 and the source S to the second connection point 2 of the bias element BS and the bias element BB. The length L of the active region of a long-gate pHEMT transistor is chosen to be much larger than is normally the case for pHEMT transistors: L may be 40 μm instead of 0.5 μm. The width W of the active region may be chosen to be 3 μm, resulting in W/L<1. The ratio of the width W and the length L of the active region can be chosen to lie in the range 0.01<W/L<0.1.

The chip area required for the resistive load of the first embodiment E1 shown in FIG. 1 is about 5570 $\mu m^2$ and has a value of 30 kΩ. The large chip area is a result of the meandering of the layout that is necessary to achieve large resistances when using low sheet resistances. For equal collector currents IC at the same supply voltage of VCC=3.4 V the chip area required for the long-gate depletion-mode pHEMT in FIG. 3 is about 342 $\mu m^2$, which is much smaller.

Figure 4:
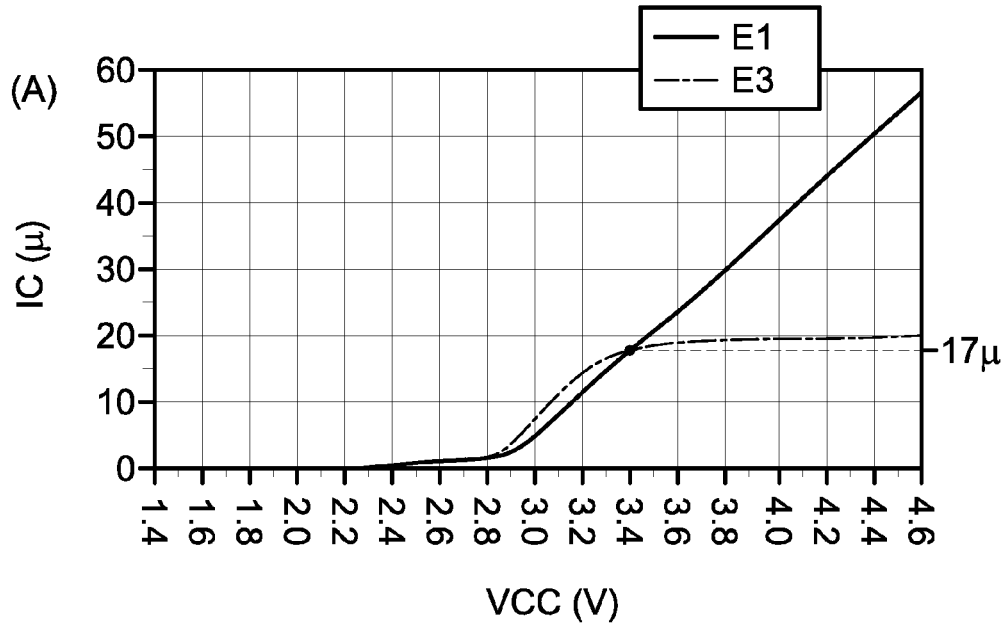
FIG. 4 illustrates collector currents of the first and third embodiments over supply voltage.

FIG. 4 shows the collector current IC in HBT3 over the supply voltage VCC for the first embodiment E1 and the third embodiment E3. It shows the linear relationship between current and voltage of the resistors used for the bias element BS and the bias element BB in the first embodiment E1 shown in FIG. 1. For the third embodiment E3, the current has a derivative that approaches zero for higher supply voltages VCC so that the collector currents in HBT3 and HBT4 are more constant over supply voltage VCC variation.

Figure 5:
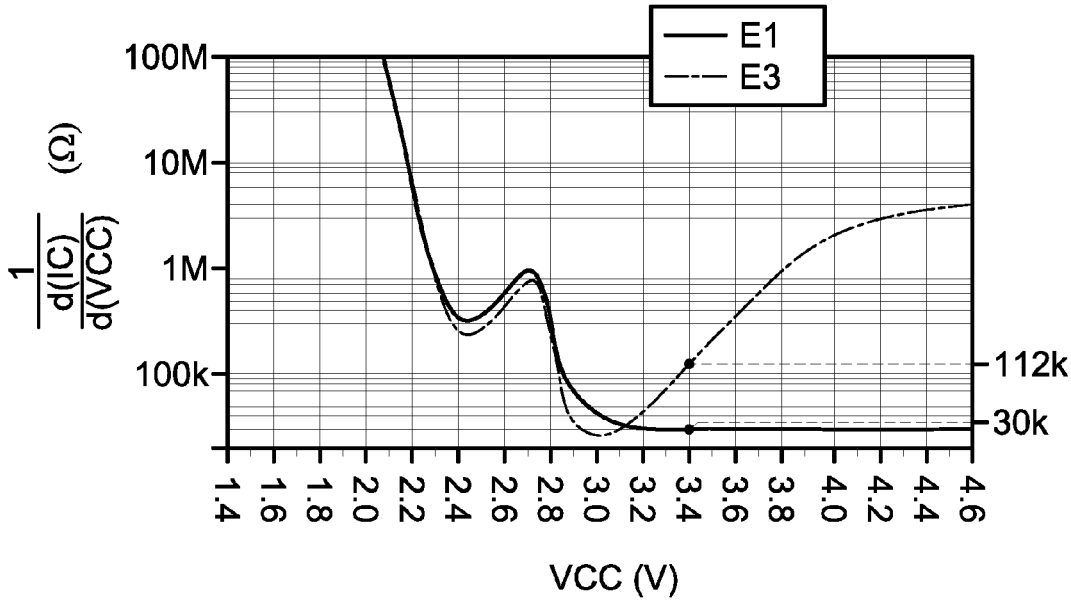
FIG. 5 illustrates load resistances of the first embodiment and third embodiments over supply voltage.

FIG. 5 shows the inverse of the derivative of the curves shown in FIG. 4. At a supply voltage of VCC=3.4 V, the first embodiment E1 has a load resistance of RL=30 kΩ and from FIG. 4, the collector current is IC=17 μA. The voltage gain of HBT3 can be calculated to be Av=20×log(gm×RL) with the transconductance gm=IC/VT≈17 μA/26 mV and the load resistance RL≈30 kΩ, leading to Av=25 dB. For the third embodiment E3, the load resistance increases into the MΩ-region for higher supply voltages VCC. At the same supply voltage of 3.4 V and the same collector current IC=17 μA, the resistance is RL≈112 kΩ, leading to a voltage gain of Av=37 dB. The voltage gain can be improved by 12 dB by replacing the thin-film resistors of the first embodiment E1 shown in FIG. 1 by the long-gate depletion-mode pHEMT transistor of FIG. 3. Also, the DC voltage headroom is improved as the DC voltage and the AC-loop gain of the long-gate depletion-mode pHEMT transistor are (much) less tightly coupled as for a resistor.

Figure 6:
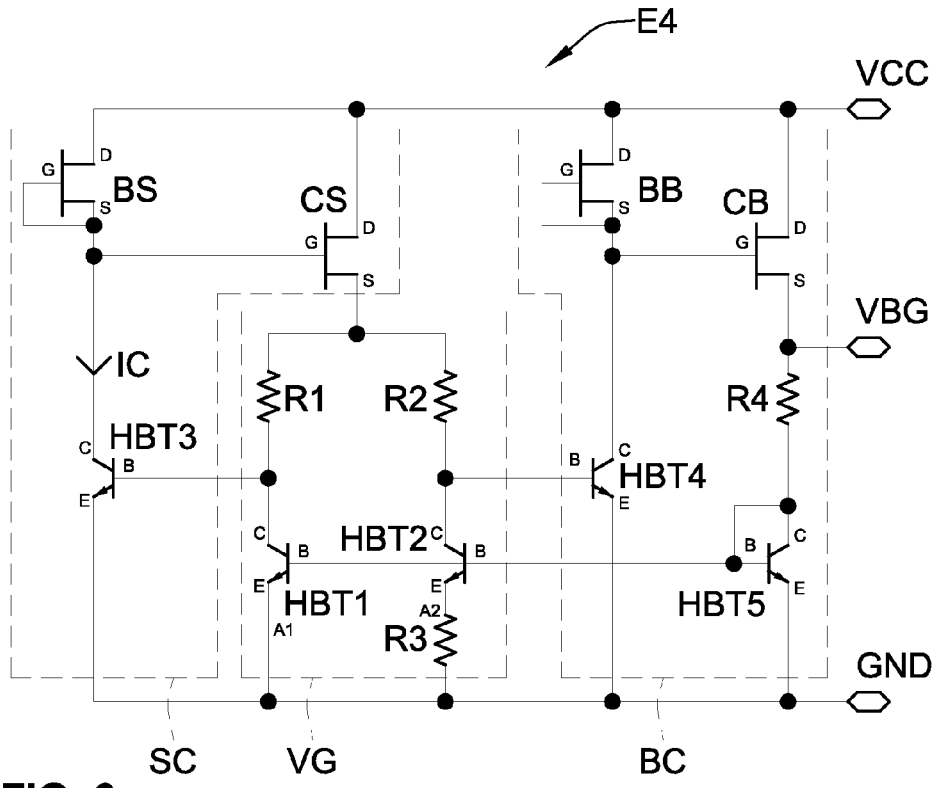
FIG. 6 illustrates a fourth embodiment of a bandgap reference circuit.

FIG. 6 shows a fourth embodiment in which FIG. 1 has been modified by using depletion-mode pseudomorphic high-electron-mobility transistors instead of hetero-junction bipolar transistors for the control element CS of the supply circuit SC and the control element CB for the bias circuit BC. Further, the resistors used for the bias element BS for the supply circuit SC and for the bias element BB for the bias circuit BC have been replaced by long-gate depletion-mode pseudomorphic high-electron-mobility transistors with their gates G shorted to the respective sources S, that is Vgs=0 V. The fourth embodiment E4 thus makes use of the advantages of the second embodiment E2 and the third embodiment E3. Where appropriate, the descriptions of the second embodiment E2 and the third embodiment E3 therefore also apply to the fourth embodiment E4.

As in FIG. 2, the minimum required supply voltage VCC can be reduced to 1.8 V for a bandgap reference voltage of 1.6 V, which is a substantial reduction in the supply voltage VCC.

Since the gate voltages of the control elements CS and CB are now substantially lower, the voltage Vds between the drain D and the source S of the bias element BS and BB of the supply circuit CS and the bias circuit BC, respectively, will be more than 1 V, so that the voltage headroom is increased. The long-gate pHEMT transistors are now biased in the saturation region and act like ideal current sources which are insensitive to supply voltage VCC variations.

The fourth embodiment E4 also allows to increase the value of the resistors R1 and R2 which will increase the loop gain.

Figure 7:
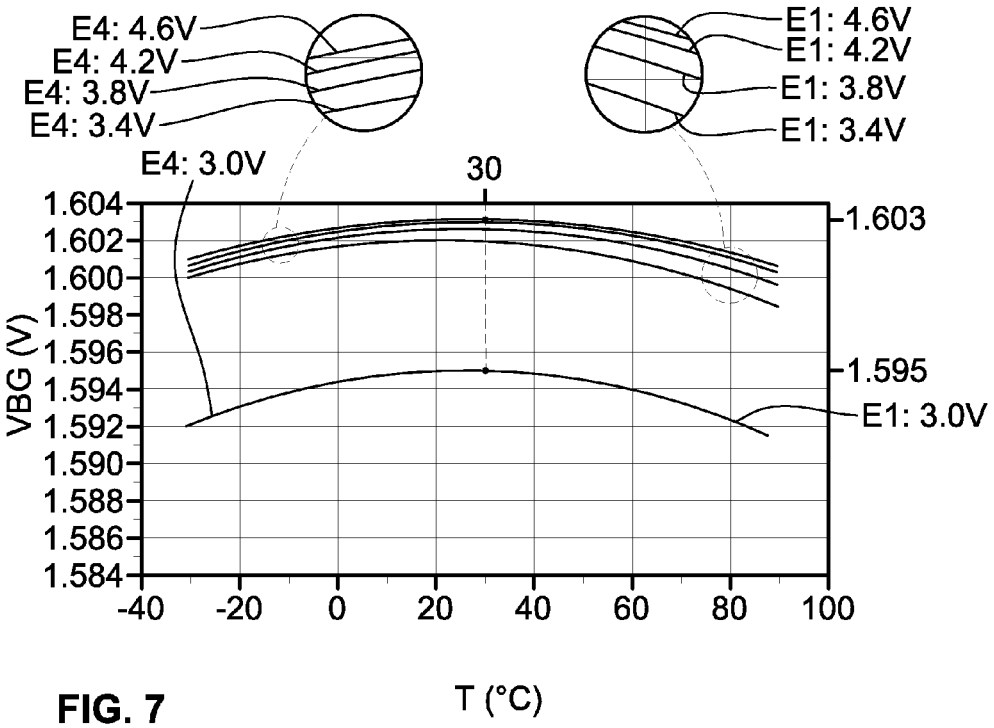
FIG. 7 illustrates reference voltages of the first and fourth embodiments over temperature with supply voltage as a parameter.

FIG. 7 shows the behavior of the bandgap reference voltage VBG of the first embodiment E1 and the fourth embodiment E4 when the circuit is not loaded. Shown are variations over the temperature T with the supply voltage VCC as a parameter. The supply voltage VCC is increased, starting at 3.0 V in steps of 0.4 V to 4.6 V. While the bandgap reference voltage VBG of the first embodiment E1 shows some variation with the supply voltage VCC, the bandgap reference voltage VBG of the fourth embodiment E4 is nearly invariant with the supply voltage VCC.

Figure 8:
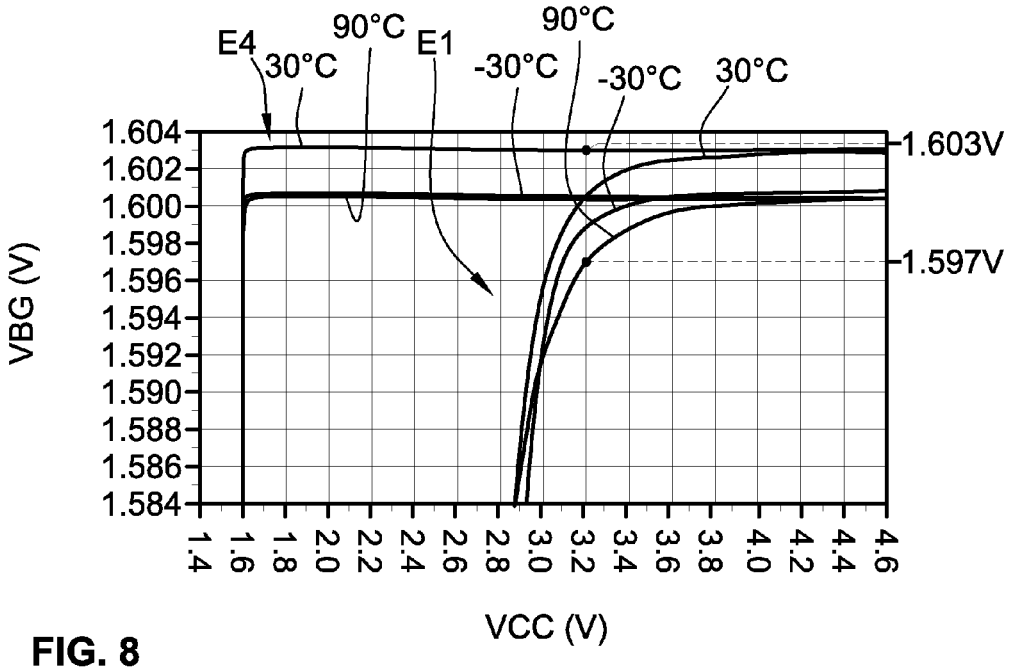
FIG. 8 illustrates reference voltages of the first and fourth embodiments over supply voltage with temperature as a parameter.

FIG. 8 shows the bandgap reference voltage VBG of the first embodiment E1 and the fourth embodiment E4 over the supply voltage VCC with the temperature as a parameter. The temperatures are −30° C., +30° C. and +90° C. Again, the bandgap reference voltage VBG of the fourth embodiment E4 is largely invariant over supply voltage VCC variations. FIG. 8 also shows that the fourth embodiment E4 requires a much lower minimum supply voltage of about VCC=1.6 V while the first embodiment E1 requires a minimum supply voltage of about VCC=2.9 V.

Figure 9:
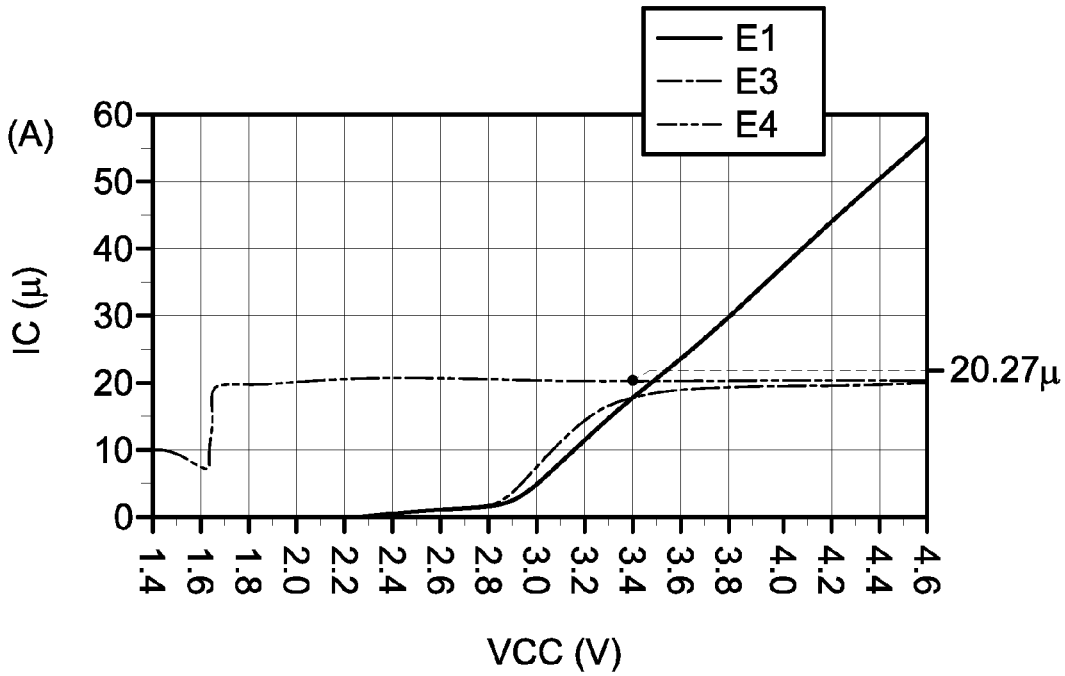
FIG. 9 illustrates collector currents of the first, third and fourth embodiments over supply voltage.

FIG. 9 corresponds to FIG. 4, where additionally the collector current IC of the fourth embodiment E4 over the supply voltage VCC is shown. The fourth embodiment produces a collector current IC at a much reduced minimum supply voltage of about VCC=1.6 V. The collector current IC is close to that of an ideal current source being constant over a large range of the supply voltage VCC.

Figure 10:
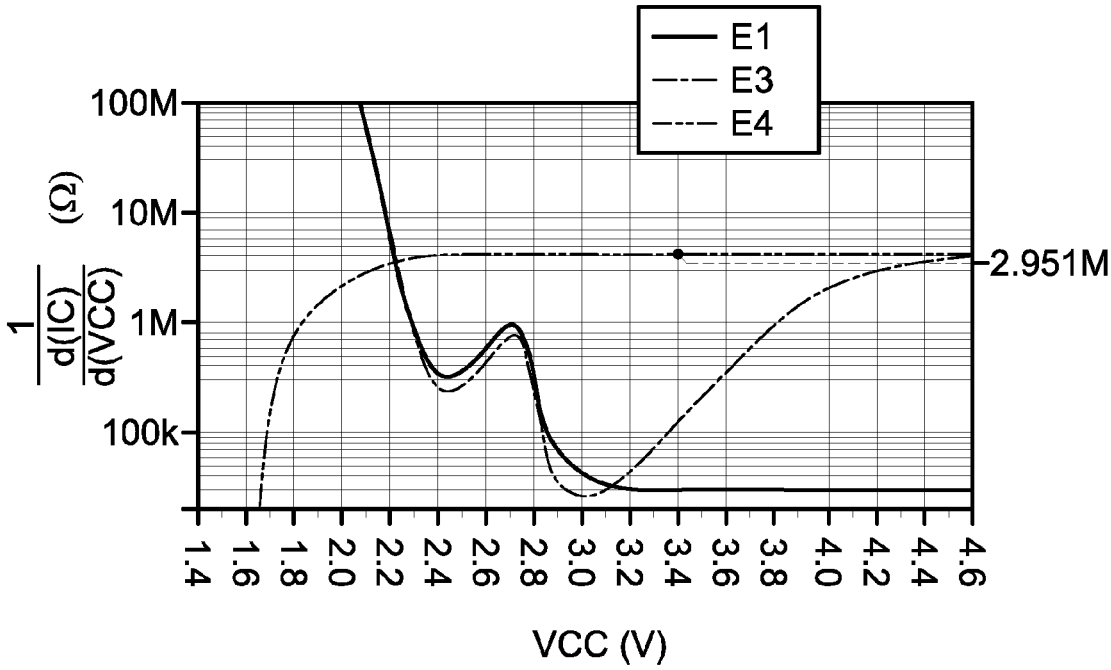
FIG. 10 illustrates load resistances of the first, third and fourth embodiment over supply voltage.

FIG. 10 corresponds to FIG. 5 and additionally shows the inverse of the derivative of the collector current IC over the supply voltage VCC for the fourth embodiment E4. At an operating voltage of VCC=3.4 V, the resistance is 2.95 MΩ, which is much larger than that of the first embodiment E1 and the third embodiment E3. In comparison with the third embodiment E3, the high resistance can be reached much earlier at about 2.4 V.

The voltage gain of the transistor HBT3 in the fourth embodiment E4 is Av=20×log(gm×RL) with gm=IC/VT≈20 μA/26 mV and RL≈2.95 MΩ at 3.4 V. At Av=67 dB it is 42 dB higher than that of the first embodiment E1.

The loop with the transistor HBT4 also has the same gain. The outstanding performance of the fourth embodiment E4 with respect to the supply voltage VCC variation can be attributed to the large loop gain which eliminates among others variations of the supply voltage VCC and variations of the load currents.

The invention thus provides a bandgap reference voltage circuit that can be operated with a much lower minimum required supply voltage VCC, occupies a smaller chip area, can have a lower current consumption and is more robust over supply voltage variations. A tradeoff has to be made between the current consumption and the loop gain, where the larger current yields a more stable bandgap reference voltage VBG.

REFERENCE SIGNS

1 first connection point
2 second connection point
3 control input
A1 emitter area of HBT1
A2 emitter area of HBT2
B base
BB bias element for bias circuit BC
BC bias circuit
BS bias element for supply circuit SC
C collector
CB control element for bias circuit BC
CS control element for supply circuit SC
D drain
E emitter
G gate
GND second supply potential
HBT1 first control element of the voltage generator VG
HBT2 second control element of the voltage generator VG
HBT3 another control element of the supply circuit SC
HBT4 another control element of the bias circuit BC
HBT5 still another control element of the bias circuit BC
R1 first resistor of voltage generator VG
R2 second resistor of voltage generator VG
R3 third resistor of voltage generator VG
R4 resistor of the bias circuit BC
S source
SC supply circuit
VBG bandgap reference voltage
VG voltage generator
VCC first supply potential

What is claimed is:

1. A bandgap reference circuit, comprising:

a voltage generator designed to produce a voltage or a current proportional to absolute temperature;

a supply circuit designed to produce a supply for operating the voltage generator, the supply circuit including a bias element and a control element; and bias circuit designed to produce a bias for operating the voltage generator, the bias circuit including a second bias element and a second control element, wherein the bias element of the supply circuit or the second bias element of the bias circuit includes a long-gate pseudomorphic high-electron-mobility transistor, wherein the long-gate pseudomorphic high-electron-mobility transistor is a depletion-mode transistor and has an active region of width W and length L, wherein $0.01<W/L<0.1$.

2. The circuit according to claim 1, wherein the pseudomorphic high-electron-mobility transistor of the control element of the supply circuit and/or the pseudomorphic high-electron-mobility transistor of the second control element of the bias circuit is a depletion-mode transistor.

3. The circuit according to claim 1, wherein the pseudomorphic high-electron-mobility transistor of the control element of the supply circuit and/or the pseudomorphic high-electron-mobility transistor of the second control element of the bias circuit is an enhancement-mode transistor.

4. The circuit according to claim 1, wherein the control element of the supply circuit or the second control element of the bias circuit includes a pseudomorphic high-electron-mobility transistor.

5. The circuit according to claim 1, wherein a gate and a source of the long-gate pseudomorphic high-electron-mobility transistor are electrically shorted or are coupled to each other by at least one electrical component so that the voltage (Vgs) between the gate and the source lies between a negative threshold voltage (Vth) and 0 V, such that $Vth<Vgs<0$ V.

6. The circuit according to claim 1, wherein a first connection point of the bias element of the supply circuit and a first connection point of the control element of the supply circuit are each connected to a first supply potential, and a second connection point of the bias element of the supply circuit is connected to a control input of the control element of the supply circuit.

7. The circuit according to claim 6, wherein the second connection point of the bias element of the supply circuit is connected to a first connection point of another control element of the supply circuit, wherein a second connection point of the other control element of the supply circuit is connected to a second supply potential.

8. The circuit according to claim 7, wherein the other control element of the supply circuit is a hetero junction bipolar transistor.

9. The circuit according to claim 1, wherein a first connection point of the second bias element of the bias circuit and a first connection point of the second control element of the bias circuit are each connected to a first supply potential, and a second connection point of the second bias element of the bias circuit is connected to a control input of the second control element of the bias circuit.

10. The circuit according to claim 9, wherein the second connection point of the second bias element of the bias circuit is connected to a first connection point of another control element of the bias circuit, and a second connection point of the other control element of the bias circuit is connected to the second supply potential.

11. The circuit according to claim 10, wherein the second connection point of the second control element of the bias circuit is connected to a first connection point of a resistor of the bias circuit, a second connection point of the resistor of the bias circuit is connected to a first connection point of still another control element of the bias circuit, the first connection point of the still another control element is connected to a control input of the still another control element, and a second connection point of the still another control element of the bias circuit is connected to the second supply potential.

12. The circuit according to claim 11, wherein the other control element and the still other control element of the bias circuit are hetero junction bipolar transistors.

13. The circuit according to claim 1, wherein the voltage generator includes a first control element and a second control element, each having a first connection point, a second connection point, and a control input, wherein the first control element and the second control element each has emitter areas that differ from one another, the control input of the first control element and the control input of the second control element are connected to the control input of the still another control element of the bias circuit, the first connection point of the first control element is connected to the control input of the further control element of the supply circuit, the second connection point of the first control element is connected to the second supply potential, and the first connection point of the second control element is connected to the control input of the other control element of the bias circuit.

14. The circuit according to claim 13, wherein the voltage generator further comprises a first resistor, a second resistor, and a third resistor, wherein a first connection point of the first resistor is connected to the second connection point of the control element of the supply circuit and a second connection point of the first resistor is connected to the first connection point of the first control element, a first connection point of the second resistor is connected to the second connection point of the control element of the supply circuit and a second connection point of the second resistor is connected to the first connection point of the second control element, a first connection point of the third resistor is connected to the second connection point of the second control element, and a second connection point of the third resistor is connected to the second supply potential.

15. The circuit according to claim 13, wherein the first control element and the second control element of the voltage generator are hetero junction bipolar transistors.

16. The circuit according to claim 1, wherein any of the control element of the supply circuit and the second control element of the bias circuit and the bias element of the supply circuit and the second bias element of the bias circuit, which are not pseudomorphic high-electron-mobility transistors, are hetero junction bipolar transistors.

17. A method for producing a bandgap reference circuit, comprising:

producing a voltage or a current proportional to absolute temperature in a voltage generator;

producing a supply for operating the voltage generator in a supply circuit having a bias element and a control element;

producing a bias for operating the voltage generator in a bias circuit having a second bias element and a second control element, wherein the bias element of the supply circuit or the second bias element of the bias circuit includes a long-gate pseudomorphic high-electron-mobility transistor, and wherein the long-gate pseudomorphic high-electron-mobility transistor is a depletion-mode transistor and has an active region of width W and length L, wherein $0.01<W/L<0.1$.

18. The method of claim 17, wherein the voltage generator includes a first control element and a second control element, the first control element and the second control element being hetero junction bipolar transistors produced using a GaAs BiFET technology process.

19. The method of claim 17, wherein the control element of the supply circuit or the second control element of the bias circuit includes a pseudomorphic high-electron-mobility transistor produced using a GaAs BiFET technology process.

* * * * *